US006954132B2

(12) United States Patent
Lell et al.

(10) Patent No.: US 6,954,132 B2
(45) Date of Patent: Oct. 11, 2005

(54) PYROTECHNIC SAFETY ELEMENT

(76) Inventors: Peter Lell, Am Mühlbachbogen 85, D-85368 Moosburg (DE); Rainer Mäckel, Ittenbacher Strasse 18, D-53639 Königswinter (DE); Thomas Schulz, IM Vornasset, D-72669 Unterensingen (DE)

( * ) Notice: Subject to any disclaimer, the term of this patent is extended or adjusted under 35 U.S.C. 154(b) by 0 days.

(21) Appl. No.: 10/421,121

(22) Filed: Apr. 23, 2003

(65) Prior Publication Data

US 2004/0113745 A1 Jun. 17, 2004

Related U.S. Application Data

(63) Continuation-in-part of application No. PCT/DE01/04016, filed on Oct. 23, 2001.

(51) Int. Cl.[7] ..... H01H 39/00
(52) U.S. Cl. ..... 337/30; 337/157
(58) Field of Search ..... 337/249, 157, 337/186, 203, 401, 404, 405, 30, 31; 200/61.08

(56) References Cited

U.S. PATENT DOCUMENTS 2,892,062 A * 6/1959 Heyser et al. ..... 337/290
3,660,794 A * 5/1972 Brizzolara ..... 337/401
3,848,100 A * 11/1974 Kozorezov et al. ..... 200/61.08
3,958,206 A * 5/1976 Klint ..... 337/406
4,296,285 A * 10/1981 Lang et al. ..... 200/61.08
4,311,890 A * 1/1982 Schroder ..... 200/61.08
4,345,127 A * 8/1982 Niemeyer ..... 200/61.08
4,571,468 A * 2/1986 Weldon ..... 200/61.08
5,360,999 A * 11/1994 Upshaw et al. ..... 307/112
6,222,439 B1 * 4/2001 Tanigawa et al. ..... 337/401
6,295,930 B1 * 10/2001 Kume et al. ..... 102/202.5

* cited by examiner

*Primary Examiner*—Anatoly Vortman
(74) *Attorney, Agent, or Firm*—The Culbertson Group, P.C.

(57) ABSTRACT

The invention relates to a pyrotechnic fuse element having a closed housing consisting of an electrically conductive material, in which an explosive is provided, the housing containing two terminal zones for electric contacting, which are electrically connected by means of the electrically conductive material of the housing, the electric connection of the terminal zones being separable by activating the explosive, and the explosive material being embodied as a deflagrating pyrotechnic substance which is provided in such an amount and is configured such that the electric connection of the terminal zones of the housing is separated in a predetermined time after the deflagrating pyrotechnic substance has been activated.

13 Claims, 5 Drawing Sheets

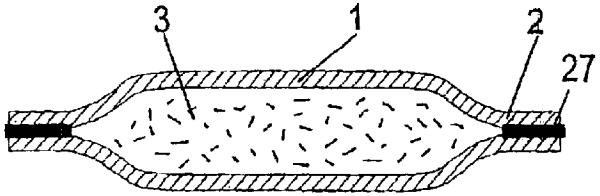
Figur 1
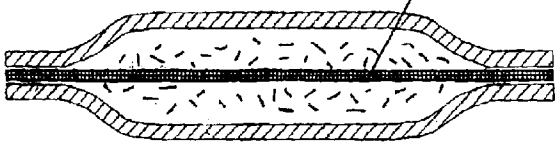
Figur 2
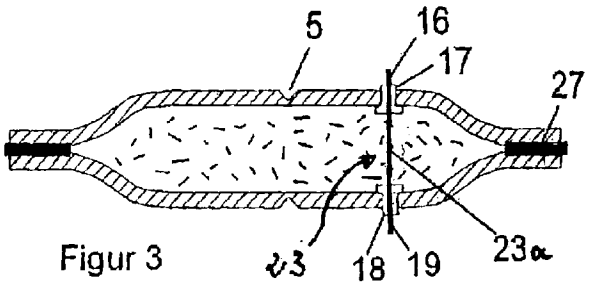
Figur 3
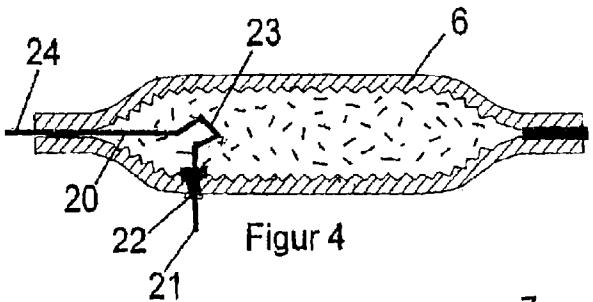
Figur 4
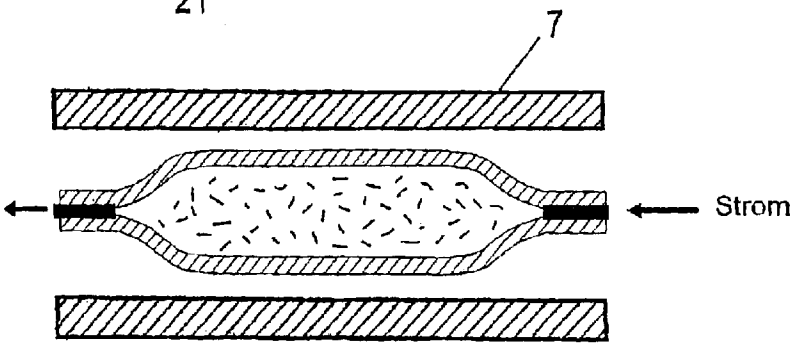
Figur 5

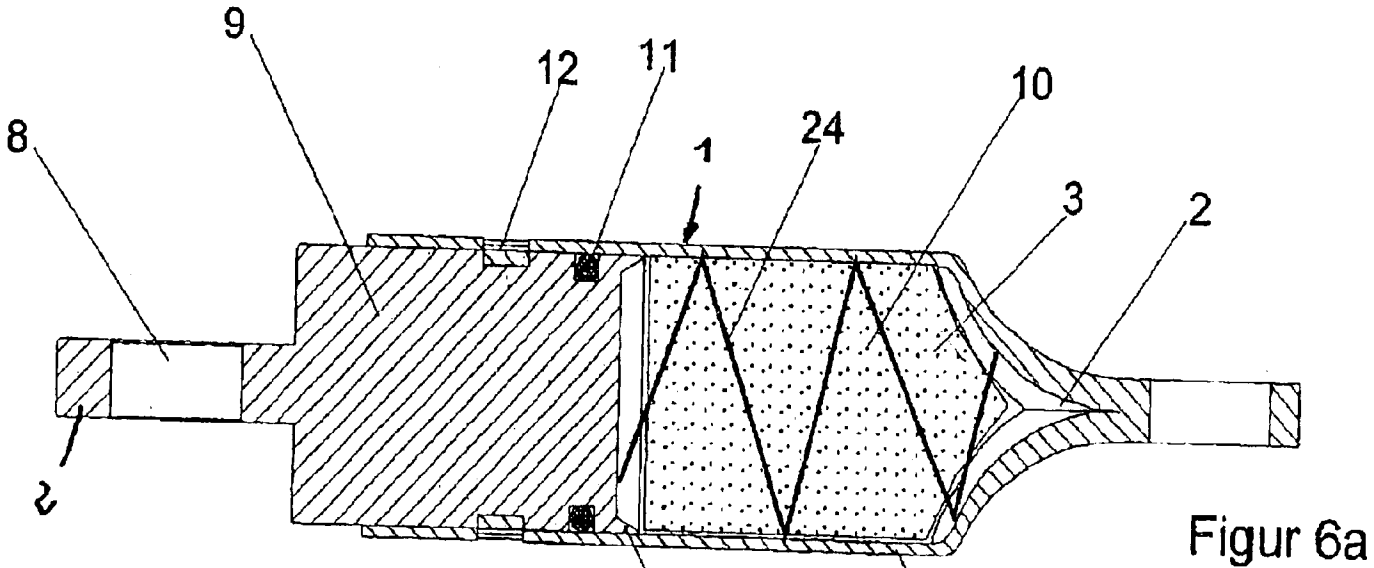
Figur 6a
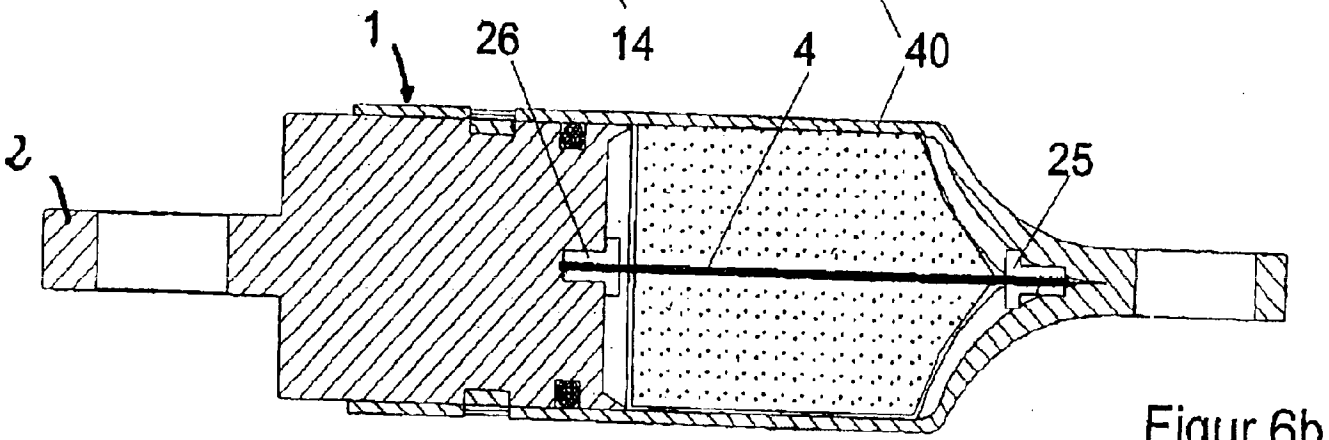
Figur 6b

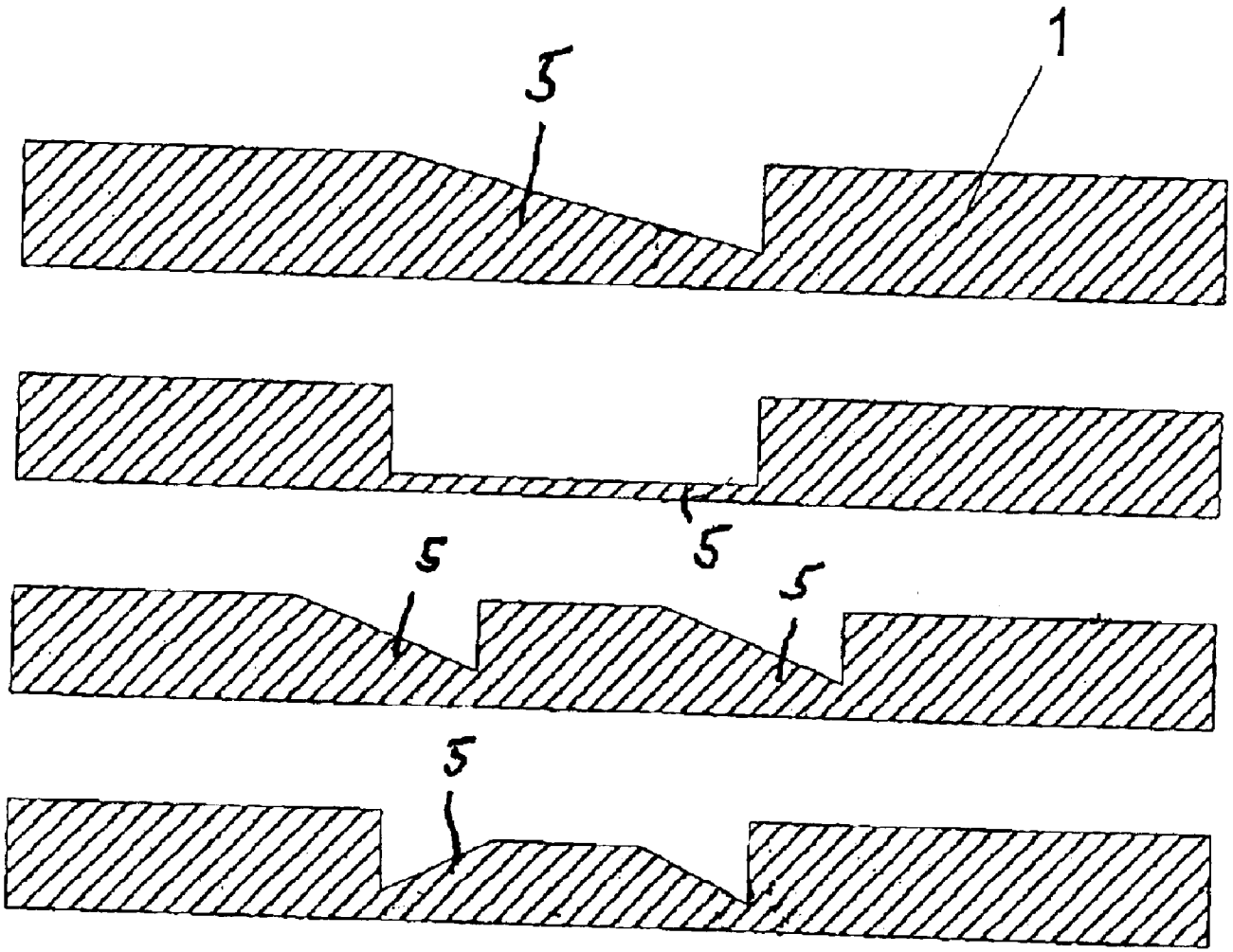
Figur 7a
Figur 7b
Figur 7c
Figur 7d

PYROTECHNIC SAFETY ELEMENT

CROSS REFERENCE TO RELATED APPLICATIONS

This is a continuation-in-part of International Application PCT/DE01/04016, with an international filing date of Oct. 23, 2001, published in German under PCT Article 21(2).

TECHNICAL FIELD OF THE INVENTION

The invention relates to a pyrotechnic fuse element which enables an electric disconnection of the current path.

BACKGROUND OF THE INVENTION

Fuse elements are used in automotive engineering, for example, in order to separate electric power circuits in a defined and quick manner in an emergency. The required standard which such a fuse element has to be up to is that its triggering and its interrupting function has to be reliably guaranteed after up to 20 years even without maintenance. Furthermore, a fuse element may not constitute an additional source of danger as a result of hot gas, particles, objects thrown or high voltages induced in the electric circuit after the latter has been turned off.

One potential field for fuse element application in automotive engineering is the defined irreversible separation of the on-board cabling from the car battery immediately after an accident in order to avoid ignition sources through sparks and plasma, which are produced if cable insulating material was abraded by parts of the car body penetrating the car during the accident, for example, or if loose ends of cables are pressed onto each other or against sheet metal parts and are abraded. If petrol leaks out at the same time in an accident, such ignition sources may ignite ignitable petrol-air-mixtures which collect under the engine hood, for example. Another field of application is the electrical separation of an electrical or electronic component from the on-board supply system in case of a short-circuit in the corresponding component, for example an electrical auxiliary heating.

Pyrotechnic fuses which are actively triggered are known from the prior art. For example, the document DE-AS 2 103 565 describes a current breaker having a metallic housing which is connected at two terminal zones spaced from each other with one end, respectively, of a conductor to be protected by a fuse. In the housing, a pyrotechnic element is provided which is formed by an explosive charge. The explosive charge can be activated by an electrical igniter, which comprises an igniting element which is evaporated by a supply current. The housing is filled with an insulating liquid. The axially extending housing comprises a circumferential groove along which the housing cracks if the explosive charge is ignited. The housing is broken open into two pieces which are electrically separated from each other, so the corresponding electric circuit is separated. In this current breaker, the plasma produced when an electric circuit with a very high current intensity is separated is extinguished by the dispersed insulating liquid. In an automotive vehicle, the fuse may be triggered by the signal of a shock sensor, for example.

A self-ignition for separating the electric circuit in case of overloading of the conductor to be protected by the fuse is not intended in this known device because the entire sleeve would have to be heated up to the ignition temperature and then a detonative combustion or reaction would not be safely achieved since a detonative explosive can hardly be ignited, that is, made to detonate by simple heating of the sleeve. This, however, would be necessary with the type of housing described in the document DE-AS 2 103 565, for example.

In pyrotechnics all over the world, a denotative reaction is said to exist when flame front speeds of more than 2000 m/s are reached.

Another disadvantage of this known device is the problem of permission for devices which contain structural components filled with explosives or even detonators. For this reason, devices of this kind have not been commercially exploited. They are only used sporadically in research institutes for special experiments. Additional reasons for this are the complicated design, the very low handling safety and the extremely high potential of danger which is very difficult to limit.

Furthermore, in many cases, there is a demand for an autoignition function of such a switch or a fuse device in order to protect a cable from overload without having to take the additional effort of providing overload sensors, for example. Thus, a corresponding fuse element should not only be capable of being triggered in a controllable manner, but it should also have the function of a conventional high-current fuse in the form of a safety fuse which can be handled by everyone without danger, as is the case with conventional safety fuses.

High-current safety fuses of this kind have the disadvantage that the turn-off time varies within a large range after the nominal current intensity of the fuse has been reached. Thus, a cable protected by such a fuse can only be loaded to a rather small extent, e.g. 30%, as far as its current carrying capacity is concerned, as otherwise a cable fire might be caused in case of overloading, for example.

From the document DE 197 49 133 A1, an emergency switch for electric circuits is known which is capable of being triggered automatically, but also of being triggered in a controllable manner. For this purpose, an electric conductor is used which has a pyrotechnic core. This core may consist of a propellant charge powder, for example. On the one hand, the pyrotechnic core may be ignited by the heating of the electric conductor when an admissible current intensity (nominal current intensity) is exceeded. On the other hand, it is intended to ignite the pyrotechnic core by means of a controllable ignition device in the form of a heating wire, for example. However, the document DE 197 49 133 A1 merely shows the principle of such a device but does not give any hints on potentially advantageous constructive embodiments. In fact, manufacturing a conductor with a pyrotechnic core of this kind requires considerable efforts. Furthermore, even in case of such an emergency switch, a safe and quick separation of the conductor can only be guaranteed if a detonative explosive is used. If deflagrating substances such as thermite are used, the conductor only bursts open and the residual gas escapes without separating the conductor entirely. The complete separation is only achieved, if at all, by the melting of the conductor as a result of the current flowing through the fuse.

From the document U.S. Pat. No. 3,958,206, a fuse is known in which the current for which the fuse is used is conducted via a fuse element filled with an exothermically reactive material; by activating the exothermically reactive material, the walls of the fuse element burst open and interrupt the current flow. As the exothermically reactive material, PETN is used, for example, that is, a detonatively reacting material, so a fuse of this kind must be up to strict approval standards. The exothermically reactive material may be activated by the dissipated heat of the current itself for which the fuse is used or by an active ignition device. However, if a material burning more slowly was used, for example a so-called propellant charge powder, the housing of the fuse element would only burst open in an undefined and inaccurate manner. Thus, there is a risk that, at the beginning, only cracks or holes are produced in the fuse element and the remaining material of the walls has to be melted by the current for which the fuse is used. This impairs the reaction velocity of the fuse and is not admissible for reasons of reliability, either.

Moreover, the document U.S. Pat. No. 3,958,206 discloses a fuse having a fuse element in the form of a flat conductor, for example, which is coated with an aluminium layer and a palladium layer on top of it. Aluminium and palladium act as exothermically reactive materials; activating the exothermic process may be effected by the dissipated heat of the current for which the fuse is used or by means of an activating device.

SUMMARY OF THE INVENTION

An object of the invention is to provide a pyrotechnic fuse element which may be equipped both with a self-triggering function and with a controllable triggering function and which is easy and cost-efficient to manufacture.

By using a separate, electrically conducting housing in which a deflagrating pyrotechnic substance is provided and which contains two terminal zones for contacting one end, respectively, of a conductor of an electric circuit to be protected by the fuse, a fuse element with small dimensions which is cost-efficient to manufacture is obtained.

Using a deflagrating pyrotechnic substance, which—contrasting to an explosive charge—merely produces a gas or a gas/particle mixture makes it comparatively unproblematic to have the fuse officially licensed. Any hazards to the surroundings can be excluded with a simple, relatively small shield housing, if necessary. For this purpose, a closed housing of a central electrical equipment or of a separate fuse box existing in an automotive vehicle is sufficient. Furthermore, for this purpose, a simple hose put upon the section to be interrupted may be provided.

In an embodiment of the invention, the housing of the fuse element may comprise a circumferential weakening portion of its outer wall. This portion may have two different functions which, depending on the constructive design of the fuse element and on the amount and type of the pyrotechnic substance, could also be fulfilled both at the same time, if necessary:

On the one hand, in a generally known way, the weakening portion may serve to cause the cracking of the housing in a defined manner along the weakening portion in order to achieve the interruption of the current flowing through the housing. On the other hand, the weakening portion may be configured such that the current flowing through the fuse generates such a high power dissipation in the area of the weakening portion, which has an increased resistance, that a self-ignition of the deflagrating material exactly at this point is achieved once a predetermined current intensity is exceeded, without the necessity of heating the fuse element as a whole. Hereby, heating takes place quickly, as desired.

For this purpose, another embodiment may comprise a housing consisting of a substantially hollow cylindrical or cup-shaped part, whose two openings at the front sides or whose one opening at the front side are closed by means of a substantially plug-like or cap-like closure element. When the pyrotechnic substance is ignited (self-ignition or ignition using an ignition device), a pressure is generated in the area of the weakening portion of the outer wall which is so high that this weakened portion of the outer wall of the housing—even with this relatively slowly rising internal pressure as compared to a detonative reaction—cracks, is aerodynamically ripped open further and then completely by the following stream of gas, and the current path is interrupted.

In another embodiment of the invention, at least one closure element is connected non-positively and/or positively and electrically with the hollow cylindrical or cup-shaped part in such a way that, by activating the deflagrating pyrotechnic substance, the mechanical connection between the closure element and the hollow cylindrical or cup-shaped part can be released and the two parts can be separated, and so the electric connection between the terminal zone provided at the hollow cylindrical or cup-shaped part and the terminal zone provided at the closure element can be separated.

Here, too, the housing, particularly the hollow cylindrical or cup-shaped part, may comprise a circumferential weakening zone. In this case, the weakening zone may be configured such that, at a predetermined nominal current, a predetermined activating temperature for the deflagrating pyrotechnic substance can be produced in specific areas by the current flowing through the housing.

At the same time, if it is configured correspondingly, the circumferential groove may serve as an additional safety means in this case, too, if the separation of the mechanical connection of the corresponding parts of the housing cannot be guaranteed because of a production defect, for example. In this case, the weakening portion may again serve to ensure that the corresponding part cracks because of the excess pressure generated if the breakage stress of the material of the housing is exceeded.

In the embodiment described above, too, in which only the cracking of the housing is intended, the weakening portion may be configured such that higher temperatures or defined temperatures occur in specific areas, preferably at corners or edges of the weakening portion, which are used for the self-ignition of the pyrotechnic material and/or that the creation of particles is securely avoided when the fuse is triggered.

In order to achieve the self-ignition, the circumferential weakening portion is preferably configured such that a portion is formed between two cross-sectional steps or discontinuities (or very steep flanks) which has a wall thickness which is clearly smaller than that of the rest of the housing, particularly in the portions adjacent the cross-sectional steps or discontinuities. The wall thickness is preferably constant in this area. The axial extension of the circumferential weakening portion is preferably 1 to 5 mm. The thickness of the portion (regardless of whether it is constant or not) is preferably smaller than half the wall thickness of the portions adjacent the cross-sectional steps or discontinuities. With these measures, one achieves that a secure tearing and cracking of the housing in the entire area of the circumferential weakening portion is effected even if relatively small amounts of a deflagrating material are used and, if desired, the circumferential weakening portion can be dimensioned such that a self-ignition of the deflagrating material can be achieved.

The portion inside the cross-sectional steps or discontinuities may comprise structures on the inside and/or the outside which have a notching effect and support the bursting or dispersing of the portion into a large number of small parts. For example, a thread may be provided on the inside. This is a very cost-efficient possibility of manufacturing such a structure.

If only a simple groove made by using a lathe or a V-shaped groove is provided as the circumferential weakening portion, a self-ignition can usually not be achieved, as the extremely short catwalk (axial extension almost zero) in connection with the elimination of heat via the housing does not make it possible to generate sufficiently high temperatures. With such circumferential weakening portions with a smaller or no axial extension (the smaller wall thickness), it is nevertheless possible to achieve a secure cracking over the entire periphery if at least part of the housing is configured to be axially movable on one side of the circumferential weakening portion. In this case, when the deflagrating material is activated, axial tensile stresses are produced which lead to the complete cracking of the housing. The axially movable part or parts can then be trapped and, if necessary, securely retained in an encompassing protective housing so that a lasting and secure interruption of the flow of current is guaranteed.

In an embodiment of the invention, the deflagrating pyrotechnic substance provided in the housing may be penetrated by an electric conductor which is connected at both its ends, respectively, with one of the terminal zones; the conductor is configured such that its heating at a predetermined nominal current will activate the pyrotechnic substance. As for its resistance, the conductor is preferably configured such that, when the nominal current flows, which is distributed among the housing and the conductor in this case, at least the conductor reaches the ignition temperature for the pyrotechnic substance.

The activating device for the controlled ignition of the pyrotechnic substance may comprise an electric conductor which can be controllably loaded with current, too. One or both ends of this conductor may be guided outside the housing, being correspondingly insulated. If only one end is guided outside, the other end of the conductor is connected with a terminal zone of the housing. The ignition current for the conductor is then branched off from the total current which flows through the fuse element.

In a different embodiment of the invention, the deflagrating pyrotechnic substance comprises a first component having a higher activating temperature and a second component having a lower activating temperature. At least the first component may comprise an ageing stability which is sufficient for the desired period of time in which it is to be operable, and it may be provided in such an amount and configured such that, when the first component is activated, this first component alone is sufficient to interrupt the electric connection between the terminal zones.

This makes it possible to create a fuse element which has to be operated at high ambient temperatures and which functions reliably over the long term, too, even in case of small differences in temperature between the ambient temperature and the temperature occurring when the nominal current flows or when the activating device is activated. In a case like this, it is usually not possible to exclusively use a sensitive pyrotechnic substance which catches fire at the activating temperature, because substances of this kind age relatively quickly at high ambient temperatures. After a short time, a large portion of the substance would already have decomposed or changed in such a way that it cannot contribute to the production of gas any more. The self-activation or controlled activation of the fuse element would not be given any more. Thus, according to the invention, a first component having a higher (usually very high) ignition temperature and sufficient ageing stability at the given high ambient temperature is used, and a further component, which can be activated at the desired ignition temperature (which is mostly considerably lower). For this second component, an ageing process is less decisive, as the first component would still be ignited by the second component even if large portions of the second component were already inactive because of the ageing process.

In the following, the invention is explained in greater detail with the aid of embodiments illustrated in the drawings.

BRIEF DESCRIPTION OF THE DRAWINGS

FIG. 1 shows a schematic view of a first embodiment of a pyrotechnic fuse element with autoignition function.

FIG. 2 shows a schematic view of a second embodiment of a pyrotechnic fuse element with autoignition function.

FIG. 3 shows a schematic view of a third embodiment of a pyrotechnic fuse element with controllable ignition function.

FIG. 4 shows a schematic view of a fourth embodiment of a pyrotechnic fuse element with controllable ignition function.

FIG. 5 shows the embodiment of FIG. 1 with a device for protection from parts of the fuse element flying outside after the element has cracked.

FIG. 6 shows longitudinal sections of two embodiments (FIGS. 6*a* and 6*b*) of fuse elements having housing parts that can be moved apart, with controllable ignition function.

FIG. 7 shows four variants of embodying a circumferential weakening portion in the walls of the housing of a fuse element according to the invention.

DESCRIPTION OF PREFERRED EMBODIMENTS

Figure 8:
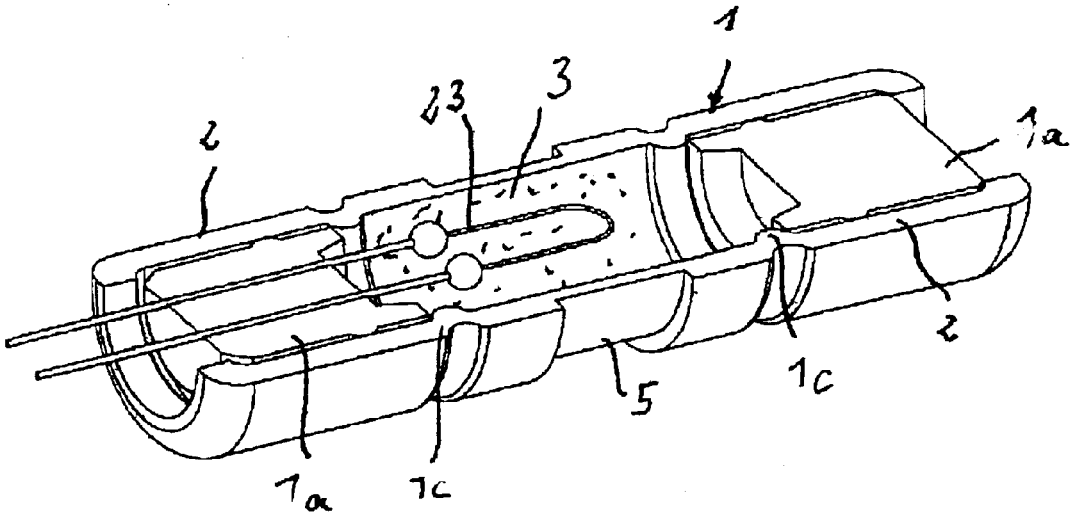
FIG. 8 shows a perspective view of a longitudinal section of an embodiment of a fuse element that is easy to realize, with controllable ignition function.

FIG. 1 schematically shows the basic structure of a first embodiment of a pyrotechnic fuse element. This element consists of a housing 1, preferably in the form of a metal tube which is simply squeezed together at the end portions 2 thereof. In the end portions 2, transverse bores may be provided so that the fuse element can be screwed to a conductor rail or that cable lugs can be screwed onto it. Thus, the end portions 2 form terminal zones for an electric circuit to be protected by the fuse or for the ends of a conductor to be protected by the fuse. The housing 1 is filled either partially or completely with a deflagrating pyrotechnic substance 3—either loosely or pressed—, preferably a propellant charge powder. At least parts of the inner walls of the housing 1 are in thermal contact with the pyrotechnic substance 3.

If a current with an intensity of the nominal current of the fuse element flows through the housing 1, the latter is heated up as a result of the power dissipation at the resistance of the housing 1 to such an extent that the ignition temperature of the pyrotechnic substance 3 is reached and the latter is ignited. After it has been activated, the pyrotechnic substance generates a gas pressure by which the housing 1 is ripped open and, as a result, the flow of current is interrupted. For this self-ignition function or autoignition function, no activating device (ignition device) and thus no external ignition signal is necessary.

If necessary, the gap between the portions squeezed together in the end portions 2 is sealed from external influences, particularly from humidity and steam penetrating into the element, by a material 27.

The pyrotechnic substance may consist of one or several components. For example, a component having a low ignition temperature or a low activating energy may be used in order to ignite an additional (main) component whose combustion gases finally destroy the housing. This makes it possible to ignite the mixture already at very low temperatures and thus to optimally load a cable to be protected by the fuse element. Thus, as the main component, a substance may be chosen which is not ignited until very high temperatures are reached. This is particularly advantageous since substances of this kind usually have a very high ageing stability. Thus, the mixture's capability of being ignitable can also be guaranteed in case of long-term and/or relatively high heating of the housing 1.

FIG. 2 shows an embodiment similar to that of FIG. 1, with the exception that an electric conductor 4, for example a wire or a strip-type core guided through the pyrotechnic substance 3, is provided additionally. The conductor 4 is connected with the end portions 2 of the housing 1. As to its resistance, the conductor 4 is dimensioned such that, when the nominal current flows through the current path of the housing 1 and the conductor 4 connected in parallel, the conductor 4 reaches a temperature which is sufficient to ignite the substance 3. Since the conductor 4 has a smaller mass compared to the housing, a fuse element of this kind is less inert as far as the delay between the point of time when the nominal current is reached and the point of time at which the substance 3 is activated is concerned. After the destruction of the housing, the conductor 4 is maintained as a current path at least for a short time. If the voltage in the electric circuit to be protected by the fuse is so high after the destruction of the housing that a very high current flows through the conductor 4, the conductor melts or burns out. If a heat-resistant material such as tungsten is chosen for the conductor, or if the voltage in the circuit to be protected by the fuse is correspondingly low, the conductor will permanently remain in the electric circuit and will serve as a current limiting resistor. Thus, in this case, the housing 1 cracks due to overload, which destroys the low-resistance current path that would have made the high short-circuit currents possible, and a relatively high-resistance current path remains for the further supply of safety devices such as emergency lighting, cellular phone, etc. which consume little energy, for example.

FIG. 3 shows another embodiment of a pyrotechnic fuse element, in which a controllable ignition function is additionally provided. In addition, a circumferential weakening portion 5 is provided in the outer walls of the housing 1. This weakening portion makes it possible to control the type of destruction of the housing 1 and, at the same time, its heating up when current flows through the housing. The smaller the wall thickness of the weakening portion 5 is, the higher the transition resistance will be in this area. Thus, the housing 1 will be heated up more heavily in this area than in portions having a thicker outer wall. At the same time, the weakening portion 5 can help to achieve that the housing is ripped open in the area of the weakening portion 5.

FIG. 3 furthermore shows a controllable activating device 23 which realizes the controllable ignition function. It consists of a conductor 23*a* which may be configured as a heating wire, for example, and comprises supply terminals 16 and 19. The two supply terminals are guided outside via the insulating bushes 17 and 18. Furthermore, the insulating bushes 17 and 18 are designed to be self-sealing, which means that they avoid the pressure drop themselves when pressure builds up in the housing 1 after the pyrotechnic substance 3 has been ignited.

FIG. 4 shows an embodiment similar to that of FIG. 3. What is shown here is a different shape of the conductor 23*a*. Of course, the conductor 23*a* can also have an arbitrary shape and can be configured as single- or multiple-coiled loops or the like, for example.

As compared to FIG. 3, in the embodiment of FIG. 4, a terminal zone 2 is connected with one end of the conductor 23*a*, so only one passage and only one external terminal remains for the internal heating wire. In this way, either a portion of the current supplied to the fuse element can be branched off and used for ignition by means of the conductor 23*a*, or an additional ignition current is introduced via the end of the conductor 23*a* that is guided to the outside.

Finally, FIG. 4 additionally shows a structure in the inner walls of the housing 1 whose purpose is to increase the contact area of the walls of the housing with the pyrotechnic substance and thus to further increase the probability of ignition.

FIG. 5 shows the embodiment of a fuse element according to FIG. 1, with a protective housing 7 being additionally provided, as is shown schematically. The protective housing 7 protects the ambience of the fuse element from splinters flying outside or from gas or a gas/particle mixture given off. Of course, the protective housing 7 may be omitted if the fuse element is built into an encompassing housing such as the housing of a fuse box or of a central electrical equipment.

Depending on the individual application, the protective housing 7 may be manufactured from a hard, but impact resistant material with an insulating effect, or from a plastics material which is soft, but has a plastic effect for small rapid particles, in which these particles penetrate and are thus "disposed of".

FIG. 6 shows two further embodiments in FIGS. 6*a* and 6*b* which are suitable for applications in which at least one cable terminal can move axially. These embodiments comprise a two-piece housing 1 which consists of the parts 9 and 40. The housing parts 9, 40 comprise one terminal zone 2, respectively. In housing part 40, which is substantially cup-shaped, the pyrotechnic substance 3 is provided. Housing part 40 may again have a weakening portion of the outer walls (not shown).

When the ignition temperature is reached in the area of a weakening portion of the outer walls or at a different position of housing part 40, the pyrotechnic substance 3 catches fire. Once a specific excess pressure is reached, a clinched portion 12, which does not only have the purpose of connecting the two parts of the housing, but also has the function of a sealing means for the pyrotechnic substance 3, is loosened and the two parts of the housing are pushed apart. In this way, the electric circuit is interrupted.

Furthermore, if necessary, a sealing system 11 may be provided for the non-activated condition. Sealing for the activated condition is in any case affected by a self-obturating sealing lip 14 of housing part 9, so the housing parts are self-sealing here.

In both end portions or terminal zones 2 of housing parts 9, 40, transverse bores 8 may be provided. With these bores, the fuse element can be screwed to a conductor rail, or a cable lug with a cable attached thereto can simply be flange-mounted. Because of the function of the fuse element according to this embodiment, at least one of the two terminal zones 2 has to be connected with an electric conductor in such a way that it is possible to push the housing parts 9, 40 apart and, in addition to this, a renewed contact of the parts of the housing after the triggering of the fuse is preferably avoided.

The embodiment of FIG. 6*a* shows a spring element 24 which serves to prestress the parts of the housing. Hereby, less pyrotechnic substance is required. For triggering the fuse element, a lower gas pressure is required. Accordingly, less kinetic energy of the two housing parts 9, 40 moving apart when the fuse is triggered is set free.

FIG. 6*b* shows an electric conductor 4 again which is connected with the terminal zone 2 of housing part 40 and housing part 9. It has the function which has already been explained before in connection with FIG. 2. Contrasting to the embodiment of FIG. 2, however, it will simply break when the fuse element is triggered, if it is only as short as is drawn in FIG. 6*b*, or will simply be pulled out of contacting jacks 25.

If it is intended to guarantee an electric connection for appliances consuming little energy even after the fuse has been activated, the wire must be coiled here so that it can be extended and does not break when the two parts of the housing move apart.

FIG. 7 shows partial views of longitudinal sections of the outer wall of the housing 1 of arbitrary embodiments in the area of the weakening portions 5. A triangular weakening portion—seen from a longitudinal sectional view—shown in FIG. 7*a* or several triangular weakening portions shown in FIGS. 7*c* and 7*d* will result in moderate heating when current flows through. The housing 1 will crack entirely and very smoothly at the position with the largest cross-sectional step or discontinuity.

With a rectangular weakening portion shown in FIG. 7*b*, the strongest heating effect when current flows through is obtained. Depending on the length of the groove, it is also avoided that heat is conducted into the thicker cross-section, which results in a more than linear temperature rise. When pressure acts upon the catwalk after the ignition of the pyrotechnic substance, the entire catwalk is sheared off on both sides and is pressed outwardly.

The multiple weakening portions according to FIGS. 7*c* and 7*d* serve to influence the switching-off-property of the fuse element: here, the decisive factors are the thermal capacity of the mid-portion which is less weakened and the number, the distance, the depth and the length of the individual weakening portions. Depending on the conditions present, portions of the housing will heat up more or less quickly there, with the flow of current being otherwise the same, and will reach the ignition temperature of the pyrotechnic substance more or less quickly.

FIG. 8 shows a perspective open view of an embodiment of a fuse element in which the housing 1 substantially comprises a hollow cylindrical part 1*b*. In the end portions or terminal zones 2 of the housing 1, plug-like closure elements 1*a* are arranged, which sealingly close the openings on the front side of the hollow cylindrical part 1*b*. The parts 1*a* may also consist of an insulating material such as plastics. The ends on the front side of the hollow cylindrical part 1*b* are bent in such a way that the parts 1*a* are held in the hollow cylindrical part by positive locking. At the same time, projections 1*c* may be provided in the inner walls of the hollow cylindrical part 1*b* in order to positively fix the parts 1*a*. The faces of the parts 1*a* directed inwardly may be configured to be self-sealing and may comprise a sealing lip, for example, which extends from the respective face to the inside and which rests against the inner walls of part 1*b* under the influence of the pressure generated by the pyrotechnic substance 3, with which the housing 1 is filled between the parts 1*a*.

As shown in FIG. 8, the fuse element is configured such that the cylindrical terminal zones can be housed in corresponding receiving portions of a fuse receiving element (not shown) and can be contacted in this way.

The effect of the circumferential weakening portions in FIGS. 7*a* to 7*d* with respect to the interruption of the electric contact is similar from a mechanical point of view, but also slightly different:

The circumferential weakening portion in FIG. 7*a* is configured and dimensioned such that, when the deflagrating pyrotechnic substance is activated, the walls of the housing 1 are ripped open over the entire periphery thereof. This ripping open is supported by the axial tensile stresses produced in the walls when a correspondingly high pressure builds up in the housing as a result of the gas produced. Contrasting to cases in which a detonative substance is used, there is no cracking and bending open of the entire walls outside the circumferential weakening portion, too. It is essential to the invention that the circumferential weakening portion has at least a sufficient predetermined axial extension, because in an embodiment with a circumferential weakening portion which comprises a single circumferential line with a minimum wall thickness, as a result of the tensile and bending stresses in the wall, the wall is not completely ripped open over the entire periphery until at least part of the wall is bent outside over the entire periphery. As shown in FIG. 7*a*, this is achieved by the wedge-shaped configuration of the wall—seen from a longitudinal sectional view—in the area of the circumferential weakening portion. What would also be possible is a wedge-shaped configuration of the weakening portion on both sides of the line with a minimum wall thickness.

In the embodiment according to FIG. 7*b*, as a result of the circumferential weakening portion which—seen from a longitudinal sectional view—is configured to be axially longer and which has a (uniform) wall thickness that is smaller than a predetermined maximum thickness, it is achieved that the circumferential thin wall portion breaks out completely. In this case, breaking out is mainly caused by the bending stress or the notch effect at the two cross-sectional steps or discontinuities. In this case, fragments of the wall portion that has broken out are created, which in practice have to be trapped in order to exclude any hazardous effect on the ambience or persons.

In the embodiments according to FIGS. 7*c* and 7*d*, the effects described above occur, too, perhaps also in a combined form. In the embodiment according to FIG. 7*d*, the portion between the cross-sectional steps or discontinuities may break out and, at the same time, the wedge-shaped portions may be bent outwardly. In the embodiment according to FIG. 7*d*, it is again the breaking out of the entire circumferential weakening portion between the cross-sectional steps or discontinuities which occurs. However, when determining the dimensions of the wall between the cross-sectional steps or discontinuities, care must be taken that the wall portion can be broken into individual pieces in order to securely interrupt the electric contact.

The embodiment according to FIG. 8 shows a conductor 23, too, which makes it possible to controllably ignite the fuse element in the way described above.

Figure 9:
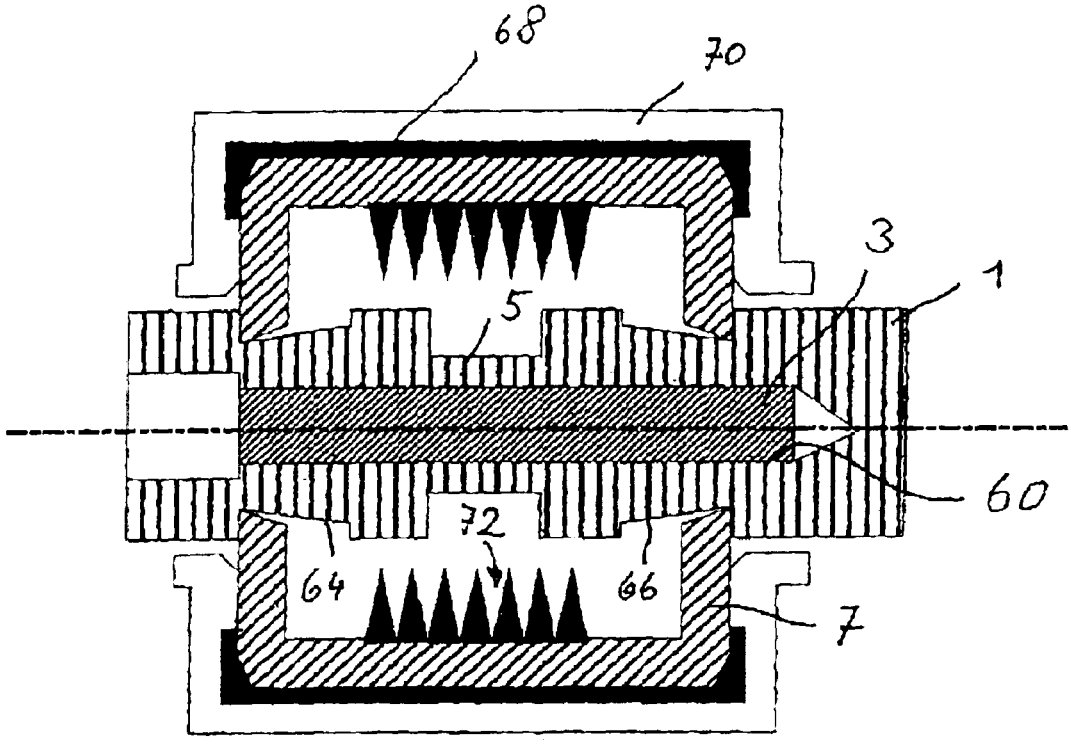
FIG. 9 shows a longitudinal section of a further embodiment of a fuse element having a protective housing in which the housing parts separated after the fuse element has been triggered are axially displaceable.

FIG. 9 shows a longitudinal sectional view of another embodiment of a fuse element with a protective housing in which the parts of the housing separated from each other after the fuse element has been triggered are axially displaceable. The housing 1 of the fuse element itself, which may consist of a conductive material such as graphite, carbon, a conductive plastics material or metal or of metal-coated materials such as carbon, graphite or plastics, is substantially configured to be cylindrical and is closed at one end thereof. In a centric bore 60, the deflagrating pyrotechnic substance 3 is provided.

At the open end of the housing 1, a receiving opening 62 for a closure element is provided (not shown), which closes the housing in such a way that it is pressure-proof. In the receiving opening, an activating device which is not shown in greater detail may also be received in order to controllably activate the deflagrating substance.

The bore 60 may comprise a thread (not shown) which extends in the wall of the housing 1 particularly in the area of the circumferential weakening portion 5. The thread constitutes a structure having a corresponding notch effect, whereby the wall is ripped open completely in the area of the circumferential weakening portion and breaks into small fragments when the deflagrating material is activated. A corresponding structure for creating notch effects may of course also be provided in the outer wall of the circumferential weakening portion by an erosive treatment of the surface, for example. At the same time, as already described in connection with FIG. 4, such an inner structure increases the probability of ignition considerably when ignition takes place as a result of a self-heating effect.

With the use of materials which are good conductors and are brittle for the housing, but at least for the circumferential weakening portion, housings 1 can be manufactured which are ripped open at small internal pressures already, the material of the circumferential weakening portion that has broken out being divided into a plurality of small pieces.

Furthermore, because of the relatively high specific resistance of materials such as graphite or carbon, the deflagrating substance can already be ignited at relatively low currents flowing through the housing. The outer surface of the housing that is not used for the catwalk can in fact be coated with a thick copper layer in particular and can thus further guarantee a very little total resistance of the fuse element.

In the embodiment according to FIG. 9, the housing 1 is surrounded by a protective housing 7 which serves to trap the fragments of the circumferential weakening portion 5 being ripped open as well as the gas produced and thus excludes that objects or persons nearby are damaged or injured. The housing 1 comprises circumferential grooves 64, 66 which project through recesses in the faces of the protective housing 7. The shoulders of the grooves 64, 66 adjacent the outer sides of the front walls, respectively, serve to axially fix the housing 1 in the protective housing 7 and rest against the front walls in the initial state.

The protective housing may consist of plastics, particularly polycarbonate, and may consist of one piece or several pieces. As shown in FIG. 9, if it consists of several pieces, the protective housing 7 may be surrounded by a tube 68 bent or bordered around the faces of the protective housing, which may consist of metal, for example. For electric insulation, a heat-shrinkable sleeve 70 or a comparable insulating means may be put on the metal tube.

When the deflagrating substance is activated, the circumferential weakening portion is ripped open over the entire periphery by the gas pressure generated. Furthermore, the axial movability of the parts of the housing 1 created thereby on both sides of the circumferential weakening portion 5 causes tensile stresses which promote the ripping open of the circumferential weakening portion 5. After the weakening portion 5 has been ripped open completely, the two separated parts of the housing 1 axially move outside in the protective housing 7 until a maximum stage is reached at which the inner sides of the faces of the protective housing 7 rest against the interior stop shoulders of the grooves 64, 66. Because of the conical thickening of the grooves 64, 66 towards the interior of the protective housing 7, the axial movement of the separated housing parts is stopped and, at the same time, the housing parts become wedged in the protective housing 7. This guarantees that the housing parts will not contact one another again after the housing 1 has been ripped open.

Contrasting to what is shown in FIG. 9, it is of course also possible that only one end of the housing 1 is held in the protective housing 7 in such a way that it is axially movable. A substantially symmetric design of the housing 1, however, also makes a symmetric design of the protective housing 7 possible, whereby sources of errors during the assembly of the entire unit are excluded.

At the inner wall of the protective housing 7, a structure 72 is provided in the area of the circumferential weakening portion in order to trap the parts of the circumferential weakening portion 5 that has been ripped open. The structure 72 may be integrally formed with the protective housing 7 or may be realized by additional material and/or an additional part. Circumferential keyways are particularly suitable, as the parts of the cracking circumferential weakening portion flung radially outwardly become wedged in the grooves tapering radially outwardly and thus cannot cause an undesired contact any more after the fuse has been activated.

The embodiment according to FIG. 9 may also be realized with a circumferential weakening portion in the form of a keyway. Here, the entire wall of the circumferential weakening portion is not broken out, but is ripped open almost exclusively by the tensile stresses created. As no particles are produced in this case, the structure 72 may be omitted. With an embodiment of this kind, however, a self-ignition of the deflagrating substance is practically impossible, as the dissipated heat generated in the weakening portion is immediately carried off by the immediately adjacent portions of the housing and by the axial extension of the circumferential weakening portion becoming almost zero (at the deepest point which basically defines the electric resistance).

Finally, it is to be remarked that all the features described above in connection with the individual embodiments can of course be combined in an arbitrary useful way.

What is claimed is:

1. A pyrotechnic fuse element including:

(a) a closed housing consisting of an electrically conductive material;

(b) two terminal zones contained in the closed housing being electrically connected by means of the electrically conductive material of the closed housing;

(c) an explosive material provided in the closed housing, the electric connection of the two terminal zones being separable by activating the explosive material, and the explosive material being made of a deflagrating pyrotechnic substance provided in such an amount and configured such that the electric connection of the two terminal zones of the closed housing is separated in a predetermined time in response to the deflagrating pyrotechnic substance being activated;

(d) a circumferential weakening portion extending over the entire periphery of an outer wall of the closed housing and formed in the thickness of the outer wall, the circumferential weakening portion having a predetermined axial extension between two cross sectional steps, and the circumferential weakening portion being configured to break out entirely at least in a partial area of the circumferential weakening portion between two defined peripheral lines in response to the deflagrating pyrotechnic substance being activated; and (e) a protective housing surrounds the closed housing and at least one part of the closed housing being axially movably held in the protective housing on one side of the circumferential weakening portion, the at least one part of the closed housing preferably including stop means at the outer periphery thereof which limit the axial movement of the closed housing after the circumferential weakening portion has broken out, and holding means being preferably provided which fix the at least one part after the at least one part has moved axially.

2. A pyrotechnic fuse element including:

(a) a closed housing consisting of an electrically conductive material;

(b) two terminal zones contained in the closed housing being electrically connected by means of the electrically conductive material of the closed housing;

(c) an explosive material provided in the closed housing, the electric connection of the two terminal zones being separable by activating the explosive material, and the explosive material being made of a deflagrating pyrotechnic substance provided in such an amount and configured such that the electric connection of the two terminal zones of the closed housing is separated in a predetermined time in response to the deflagrating pyrotechnic substance being activated;

(d) a circumferential weakening portion extending over the entire periphery of an outer wall of the closed housing and formed in the thickness of the outer wall, the circumferential weakening portion having a predetermined axial extension between two cross sectional steps, and the circumferential weakening portion being configured to break out entirely at least in a partial area of the circumferential weakening portion between two defined peripheral lines in response to the deflagrating pyrotechnic substance being activated; and (e) an electric conductor to penetrate the deflagrating pyrotechnic substance provided in the closed housing, the electric conductor being connected at both its ends, respectively, with one of the terminal zones, the conductor being configured such that its heating at a predetermined nominal current will activate the pyrotechnic substance.

3. A pyrotechnic fuse element including:

(a) a closed housing consisting of an electrically conductive material;

(b) two terminal zones contained in the closed housing being electrically connected by means of the electrically conductive material of the closed housing;

(c) an explosive material provided in the closed housing, the electric connection of the two terminal zones being separable by activating the explosive material, and the explosive material being made of a deflagrating pyrotechnic substance provided in such an amount and configured such that the electric connection of the two terminal zones of the closed housing is separated in a predetermined time in response to the deflagrating pyrotechnic substance being activated;

(d) a circumferential weakening portion extending over the entire periphery of an outer wall of the closed housing and formed in the thickness of the outer wall, the circumferential weakening portion having a predetermined axial extension between two cross sectional steps, and the circumferential weakening portion being configured to break out entirely at least in a partial area of the circumferential weakening portion between two defined peripheral lines in response to the deflagrating pyrotechnic substance being activated; and (e) a protective housing which is configured such that the ambience of the fuse element is protected when the outer wall of the closed housing breaks out during activation of the deflagrating pyrotechnic substance.

4. The pyrotechnic fuse element of claim 3 wherein the closed housing includes a substantially hollow cylindrical part with at least one opening that is closed by means of a substantially plug-like closure element.

5. The pyrotechnic fuse element of claim 3 further including at least in partial areas of the inner wall of the closed housing which contact said deflagrating pyrotechnic substance, structures are provided which increase the surface effectively contacting said pyrotechnic substance and are configured such that in predetermined areas, locally higher temperatures or notch stresses are produced which facilitate the destruction of the circumferential weakening portion and cause smaller fragments.

6. The pyrotechnic fuse element of claim 3 further including a controllable activating device for the deflagrating pyrotechnic substance.

7. The pyrotechnic fuse element of claim 3 wherein the deflagrating pyrotechnic substance includes a first component which has a higher activating temperature than a second component.

8. The pyrotechnic fuse element of claim 7 wherein at least the first component has an ageing stability which is sufficient for the period of time in which it is to be operable, and the ageing stability is provided in such an amount and configured such that, when the first component is activated, the first component alone is sufficient to interrupt the electric connection between the terminal zones.

9. The pyrotechnic fuse element of claim 7 wherein the activating temperature of the first component is higher than the temperature which can be produced at least by partial areas of the closed housing at a nominal current intensity and the activating temperature of the second component is lower than the temperature which can be produced at least by partial areas of the closed housing at a nominal current intensity.

10. The pyrotechnic fuse element of claim 3 wherein the predetermined axial extension of the circumferential weakening portion includes a wall thickness that is larger than zero and preferably larger than 1 mm and smaller than 5 mm.

11. The pyrotechnic fuse element of claim 10 wherein the wall thickness in the area of the weakening portion is smaller than half the wall thickness of the portions adjacent the weakening portion and is preferably constant.

12. The pyrotechnic fuse element of claim 3 wherein the circumferential weakening portion of the outer wall is configured such that, at a predetermined nominal current, a predetermined activating temperature for the deflagrating pyrotechnic substance can be produced in predetermined areas by the flow of current through the housing.

13. The pyrotechnic fuse element of claim 3 wherein the deflagrating pyrotechnic substance and the closed housing are configured such that, at a predetermined nominal current intensity, a secure activation of the pyrotechnic substance by the heating of the closed housing, preferably in predetermined areas, is guaranteed.

* * * * *